United States Patent [19]

Goessler

[11] Patent Number: 4,810,857

[45] Date of Patent: Mar. 7, 1989

[54] RADIANT HEATER UNIT

[75] Inventor: Gerhard Goessler, Oberderdingen, Fed. Rep. of Germany

[73] Assignee: E.G.O. Elektro-Gerate Blanc u. Fischer, Fed. Rep. of Germany

[21] Appl. No.: 62,949

[22] Filed: Jun. 16, 1987

[30] Foreign Application Priority Data

Jul. 3, 1986 [DE] Fed. Rep. of Germany ..... 3622415

[51] Int. Cl.[4] ..... H05B 3/74

[52] U.S. Cl. ..... 219/464; 219/459; 219/446; 219/449

[58] Field of Search ..... 219/464, 445, 446, 458, 219/459, 460, 463, 456, 443, 461, 449, 450, 465, 466

[56] References Cited

U.S. PATENT DOCUMENTS

| | | | |
|---|---|---|---|
| 1,979,471 | 11/1934 | Knopp | 219/449 |
| 3,912,905 | 10/1975 | Giler | 219/464 |
| 4,574,187 | 3/1986 | Crews | 219/541 |
| 4,639,579 | 1/1987 | Brooks | 219/464 |

FOREIGN PATENT DOCUMENTS

| | | | |
|---|---|---|---|
| 807698 | 7/1951 | Fed. Rep. of Germany . | |
| 905800 | 3/1954 | Fed. Rep. of Germany . | |
| 2650321 | 5/1977 | Fed. Rep. of Germany . | |
| 2729929 | 8/1980 | Fed. Rep. of Germany . | |
| 8133341 | 3/1982 | Fed. Rep. of Germany . | |
| 3206024 | 9/1983 | Fed. Rep. of Germany . | |
| 8400644 | 10/1984 | Fed. Rep. of Germany . | |
| 3314501 | 10/1984 | Fed. Rep. of Germany . | |
| 3410442 | 9/1985 | Fed. Rep. of Germany . | |
| 266979 | 8/1950 | Switzerland . | |
| 2087698 | 5/1982 | United Kingdom | 219/464 |

*Primary Examiner*—Teresa J. Walberg
*Attorney, Agent, or Firm*—Steele, Gould & Fried

[57] ABSTRACT

In a radiant heater unit (1) for heating through a hot-plate (2), the periphery of the heating field is formed by an initial cooking marginal heating system (9), which is e.g. operated by a short-circuit connection (19), so that it passes much more rapidly from the cold state into the visible glowing state and also in the marginal region use is made of the faster heat transfer there to the bottom (3) of the cooking utensil. The increased radiant power density can also be obtained by other measures, namely by modified insulating conditions in the vicinity of the marginal heating system, by using a PTC resistor in the vicinity of the inner partial power system and similar measures.

28 Claims, 2 Drawing Sheets

7
3
2
15
16
8
13
5
4
6
17
18
19
9
11
1

10
9
11
6
7
1
4
18
8
14
12

3
2
7
8
1
4

RADIANT HEATER UNIT

BACKGROUND OF THE INVENTION

1. Field of the Invention

The invention relates to a radiant heater unit for heating a heater plate, particularly a glass ceramic hotplate with at least one cooking point, with a support for an electric radiant heater comprising at least one radiant heater resistor, such as a heater coil, which extends from an annular periphery of a heating field determining a fixed heating field size via a central zone into an inner zone of the heating filed.

2. Prior Art

It is desirable in numerous cooking processes to achieve a very short initial cooking time, i.e. at the start of the cooking process the product being cooked is carefully heated to a predetermined temperature level over a minimum period of time, after which with reduced power regulated by means of a temperature switch or controlled by means of a power control device final cooking takes place, without it being necessary to separately operate the electrical operating member for manually selecting a power level at the cooking point. This automatic control of the heat emission of the cooking point is desired in such a way that after passing once from the initial cooking phase into the final cooking phase, it does not automatically return to the initial cooking phase, unless it is completely switched off and by corresponding cooling is made ready again for carrying out the next initial cooking phase.

It is also desired in the case of radiant heater bodies that, after switching on a cooking point, radiant heat is supplied in the visible wave range in a minimum period of time, so that the cook is able to recognise by means of the visible glowing of the associated radiant heater that the cooking point is ready to operate and consequently as rapidly as possible a high radiant power density or heat output is available.

Attempts have already been made to obtain this thermal and optical behaviour of a radiant heater body in that on the periphery of the heating field a separate radiant heating resistor is provided, which is switched in during the initial cooking or heating phase and remains switched off after this phase. Such an externally, separately switchable heating resistor also exists for those cooking points which can be switched between two fixed heating field dimensions so that, as desired, it is possible to switch to cooking utensils having different plan view sizes. Admittedly such arrangements in part lead to good results, but the disconnection of the heating resistor switched in during the initial cooking phase during the final cooking phase leads to a relatively non-uniform, specific heating of the bottom of the cooking utensil. In addition, for this purpose power control devices with additional switches are required.

An object of the present invention is to provide a radiant heater body of the aforementioned type, in which the time from switching on up to reaching a visible glow and therefore also the initial cooking time can be considerably shortened compared with hitherto known radiant heater bodies, which in particular have at least one exposed heating resistor.

According to the invention this object is achieved with a radiant heater body of the aforementioned type in that an area of the radiant heater belonging to a partial power system forms the periphery of the heating field and as marginal heating over at least part of the initial cooking phase there is a radiant power density which is higher than an area of the radiant heater located within it and belonging to at least one further partial power system. The initial cooking marginal or edge heating is not switched off at the end of the initial cooking phase and instead reverts to within a small difference of its radiant power density compared with the radiant heater area located within it. A variable initial cooking circuit is obtained which, at during the initial cooking phase at least temporarily supplies a faster heat evolution in the marginal area of the radiant heater body, i. e. where as a rule due to the conventional bottom shape of cooking utensils there is the best contact between said bottom and the hotplate. The increased positive power difference during the initial cooking phase with which the marginal heating system is operated compared with the standard partial power system can also be used to ensure that the thus operated marginal heating system glows visibly in an extremely short time after switching on the cooking point and thereby optically indicates the full readiness of said cooking point to operate.

The described heat emission behavior of the initial cooking marginal heating system, which is also further operated in the final cooking phase, can e.g. be achieved in a simple manner in that the initial cooking marginal heating system is provided or switched substantially over the entire initial cooking phase with a relatively high power level.

A particularly easy switching from the initial cooking phase to the final cooking phase can e.g. be brought about in that a partial power system of the radiant heater is switched in substantially time-dependent manner, preferably by means of a temperature switch with high switching temperature difference or hysteresis. This temperature switch only disconnects at a relatively high temperature influencing or controlling its temperature sensor and only switches in or connects again at a relatively low temperature such as can be achieved through complete disconnection and corresponding cooling and which is not normally reached by the radiant heater body during final cooking. Instead of this or in addition thereto this behavior characteristic of the temperature switch can also be achieved in that thermal coupling of the temperature sensor of the temperature switch is made so low to the radiant heater or radiant heater body, that only on reaching the end of the initial cooking phase is the temperature sensor heated to the disconnection temperature by heat conduction and then due to low heat dissipation through corresponding insulation can no longer cool to its switch-on temperature during the final cooking. Thus, there is a time-dependant control of the initial cooking phase using switching members responding exclusively to temperature influences.

A particularly simple embodiment of the invention is provided in that during the initial cooking phase at least one predetermined part of the radiant heater, i.e. at least one heating resistor is switched off by short-circuiting. Thus, it is possible to achieve a significant increase in the power in the outer region of the heating field without particular effort and expenditure, said solution even being suitable for those very simple radiant heater bodies having only a single radiant heating resistor, i.e. only a single electric heating circuit.

In particular in place of such a short-circuit connection for at least one part of the radiant heater located within the periphery, it is possible to form at least one such inner part by means of a radiant heating resistor having a high positive temperature coefficient (PTC). The device influencing the transfer from the initial cooking phase into the final cooking phase can then be formed exclusively by the associated radiant heating resistor, because as a result of its characteristic behavior, the PTC resistor brings about the desired reversal.

An even further simplified and manufacturing favorable solution of the inventive problem can be provided in that the initial cooking marginal heating system is formed by a separate and in particular single-strand heating circuit extending over a maximum of only 360°, which is optionally bifilar and is i.e. returned backwards and forwards twice and which is preferably always connected parallel to the inner part of the radiant heater. As a result of its arrangement on the periphery of the heating field, said heating conductor can be much higher loaded than the heater coil located within it and e.g. taking up the remainder of the heating field, so that there is a much faster visible glowing of this area of the heating field, as well as a shorter initial cooking time.

In addition to the above-described measures, but also in place thereof, an advantageous solution of the objects of the invention can be achieved in that the initial cooking marginal heating system is connected to the support with a lower thermal conductivity coupling than the inner part of the radiant heater, so that the specific heat dissipation from the marginal heating system into the support is much lower than that of the inner part of the radiant heater and consequently the marginal heating system glows visibly much more rapidly after switching on. This lower specific heat dissipation can be achieved by different, relatively simple measures, e.g. by a lower specific surface contact between the associated heating resistor and the support, by using a support material with a lower specific thermal conductivity in the vicinity of the marginal heating system and by other similar measures. In this case, without using a separate control or regulating device, the initial cooking control device can be exclusively formed by the thermal conduction connection between the radiant heater and the support, because towards the end of the initial cooking phase only the characteristics of this thermal conduction connection are used.

A particularly low specific thermal conduction connection between the marginal heating system and the support can e.g. be achieved in that longitudinal portions of the associated heating resistor are arranged in substantially freely suspended and contact-free manner with respect to the support, i.e. can run in contact-free or taut manner between suspended parts in the manner of suspension bridge sections.

The longitudinal portions of the heating resistor with a lower thermal conduction coupling to the support can also be obtained in that they are located in regions of the support, which have a different thermal conductivity from the material thereof and which are e.g. formed by an insulating or thermally insulating material which, although unsuitable for the direct mounting of the heating resistor, still has very good insulating characteristics.

Such an insulating material is used for radiant heater bodies, e.g. as an underbedding of a cup or disk-shaped insulating support body, which although having lower thermal insulation values, is suitable for a reliable mounting of the heating resistor by direct embedding. In this case the relatively dimensionally stable insulating support body can be provided with openings in the vicinity of said longitudinal portions of the heating resistor and into which appropriately project upwardly directed projections of the embedding, in such a way that said projections substantially completely fill the openings, at least in plan view. At least partially in the height direction said projections are set back with respect to the front side belonging to the heating resistors and/or can be at least partly advanced with respect thereto. The insulating support body can e.g. be a relatively firm or solid molded article made from mineral fibers constituted by a material, such as that e.g. known under the trade name "Fiberfrax", whilst the underbedding is based on pyrogenic silicic acid.

If an interruption of an electric circuit is used for switching from the initial cooking phase to the final cooking phase, the initial cooking control device appropriately has a temperature sensor operating the associated switch and which is preferably thermally insulated by means of an insulating layer compared with the radiant heater, which can be simply achieved without special insulating measures in that the temperature sensor is embedded in the already present insulating material of the support, i.e. is located on the radiant heating resistor side remote from the hotplate. If the temperature sensor is constructed as an expansion rod sensor, it can be embedded in simple manner in the insulating support by mere insertion and its control or switching head can be located outside the support. This switch acting in the manner of a temperature protection switch can also be formed by a so-called Klixon thermostat, which cooperates with a heat conducting rod, which transfers the heat from the sensing point to the temperature sensor e.g. formed by a bimetallic sensor in the thermostat switching head.

These and further features of preferred further developments of the invention can be gathered from the description and drawings and individual features can be realised singly or in the form of subcombinations in an embodiment of the invention and in other fields.

BRIEF DESCRIPTION OF THE DRAWINGS

Embodiments of the invention will now be described relative to the drawings, wherein.

DETAILED DESCRIPTION OF THE PREFERRED EMBODIMENTS

Figure 1:
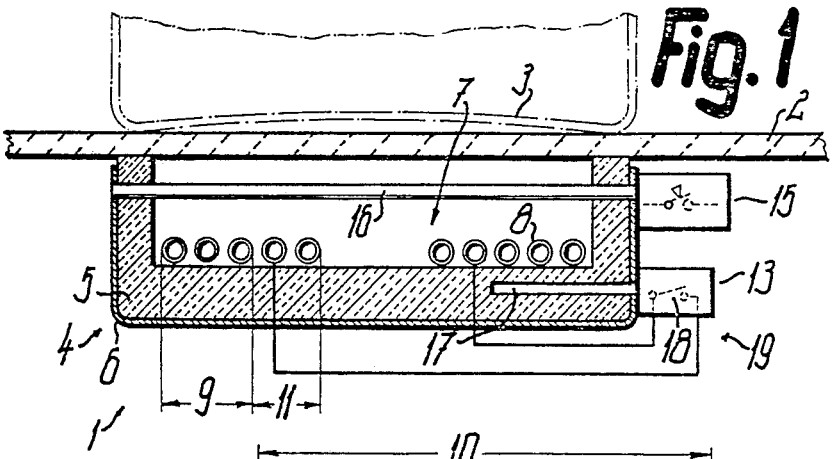
FIG. 1 shows a radiant heater body according to the invention in cross-section and simplified representation.
Figure 2:
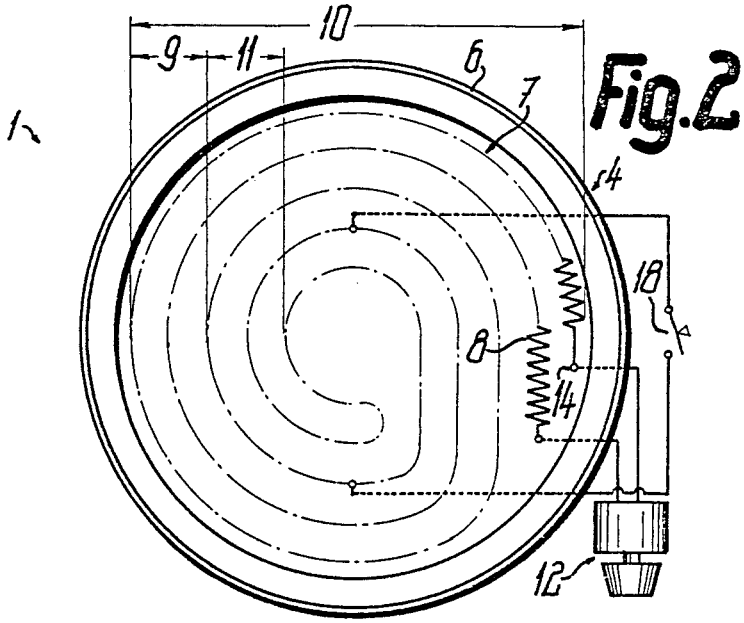
FIG. 2 is the radiant heater body according to FIG. 1 in plan view.

As shown in FIGS. 1 and 2, an inventive radiant heater body 1, which is intended for positioning on the underside of a glass ceramic or similar translucent hotplate 2, has a dish or cupshaped support 4. Support 4 essentially comprises an inner tray, dish or shell 5 in one or more parts and formed from at least one insulating material and a relatively thin-walled outer tray, dish or shell 6 serving to protect and mount the inner shell 5 and which is preferably made from sheet steel. On its substantially flat bottom or which is parallel to hotplate 2, inner shell 5 carries a radiant heater 7 to be operated by an electric current and which is in the form of at least one non-encapsulated heating resistor 8. However, it is also possible to operate at least part of the power of the radiant heater body 1 with an encapsulated radiant heater body, i.e. a bulb lamp, such as a halogen light source. However, preferably the radiant heater body only has non-encapsulated heating resistors.

Heating resistor 8 is placed in the form of a double spiral around the central axis of radiant heater body 1, in such a way that its two connection ends 14 are located on the periphery of heating field 10 essentially defined by the outermost approximately circularly closed spiral turn. A predetermined number of outer turns of heating resistor 8, namely in the represented embodiment roughly half of all the turns or approximately three spiral turns, are provided as initial cooking marginal heating system 9 for operation with a relatively high radiant power density during the initial cooking phase, whereas the remaining turns of said same heating resistor located within said marginal heating system 9 form a residual partial power system 11, which can be operated with a variable power gradient compared with marginal heating system 9.

The complete radiant heater 7, i.e. the sole heating resistor 8 is operated throughout the heating operation by means of an adjustable control device or an e.g. timing power control device and when same is interposed, radiant heater 7 is connected to current from the mains. Appropriately in the space between radiant heater 7 and hotplate 2 there is a temperature sensor 16 crossing the heating field 10 and in the case of using a regulating device 12 for the operation of radiant heater 7, it can control the same or be associated with a thermal cut-out 15, whose switching head is located directly on the outside of the support 4 traversed by temperature sensor 16.

For the operation of radiant heater 7 in the initial cooking phase on the one hand and in the final cooking phase on the other differing with respect to the relevant radiant power density, there is an additional control device 13, whose temperature sensor 17 is exposed to the temperature in the interior or in the full cross-section of inner shell 5. Temperature sensor 17, which can be an expansion rod sensor with an outer tube and an inner rod with a different expansion coefficient located therein or a heat conducting rod, which supplies the heat from the sensing point to the switching head of regulating device 13 located on the outside of support 4 below the switching head of thermal cut-out 15, is also parallel to hotplate 2, but is below the bottom surface of inner shell 5 receiving radiant heater 7 and above the underside thereof, i.e. on the side of radiant heater 7 remote from the hotplate 2 or temperature sensor 16, is embedded in the insulating material of inner shell 5 and is approximately radial with respect to the central axis of the radiant heater body 1. This temperature sensor 17 can be shorter than half the width of heating field 10, so that it is only located on one side of its central axis substantially exclusively in the vicinity of the associated turns of marginal heating system 9. The initial cooking switch 18 in the form of e.g. a snap-action switch and which is not directly connected to the power supply for the radiant heater 7 and which is positioned in the switching head of the control device 13 constructed as a disconnection device is located in a circuit provided as a short-circuit for the partial power system 11, i.e. it is so electrically conductively connected by means of its two connection poles exclusively with two spaced points of the heating resistor 8, that when the initial cooking switch is closed, the longitudinal portion of heating resistor 8 belonging to the partial power system 11 and occupying the inner zone of heating field 10 is substantially put out of operation by short-circuiting. Therefore the remaining longitudinal portion of heating resistor 8 belonging to the initial cooking marginal heating system and extending substantially up to the periphery of heating field 10 is operated with a relatively significantly raised radiant power density with the short-circuit circuit 19 closed and after switching on is very rapidly heated to such an extent that through hot plate 2 it is possible to see a visible glow. As soon as the temperature sensor 17, which can be embedded in intimate contact with the insulating material or in a cavity within the inner shell 5 in a substantially contact-free manner has been heated with the time lag resulting from its thermally insulated arrangement to the disconnection temperature of control device 13, the initial cooking switch 18 opens, so that now also the longitudinal portion of heating resistor 8 belonging to the partial power system 11 passes into full power operation and consequently the difference between the radiant power density between the area of the initial cooking marginal heating system 9 and that of the partial power system 11 is at least reduced. Thus, during initial cooking increased power is available for an optimum long period, without there being reswitching to increased power again during final cooking and following the response of the temperature monitor forming the regulating device 13.

The shortening of the initial cooking time to be obtained through the inventive construction results from the fact that the bottom 3 of the cooking vessels is generally curved in such a way that said bottom 3 in the vicinity of its outer rim has the most direct contact with hotplate 2 and therefore a particularly rapid heat transfer is possible there. The arrows in FIG. 3, whose length represents the radiant power density, illustrate the fact that in the invention an operating arrangement is provided which is such that in the initial cooking phase the power density is greatest in said marginal area. In the final cooking phase this external power density can be returned in the marginal area 9, the power density can be raised in the vicinity of the partial power system 11, or both processes can be performed simultaneously. The switching hysteresis of the control device 13 is made so large that prior to the almost cooling of the radiant heater body 1 it does not switch back again into the short-circuit position, i.e. with the initial cooking switch 18 closed.

In place of the short-circuiting for the initial cooking phase the longitudinal portion of heating resistor 8 belonging to the inner partial power system 11, said longitudinal portion can also be formed by a heating conductor with a high positive temperature coefficient, which is e.g. made from molybdenum disilicide. This PTC resistor admittedly switched by a separate longitudinal portion in series with the remaining heating resistor or with that belonging to the initial cooking marginal heating system 9, as a result of its lower initial resistance, immediately after switching on the radiant heater, it leads to a very high starting current and said PTC resistor by rapid heating to the glowing temperature also optically indicates a similarly rapid heating of the radiant heater body, such as is the case when tungsten halogen lamps are used as the radiant heater. Then its rising inherent resistance automatically switches back the power in the final cooking phase.

Support 4 with the end face of the shell edge of inner shell 5 is tensioned under pressure in whole-surface manner against the inside or underside of the hotplate, so that i.e. the inner circumference of said bearing edge substantially coincides with the periphery or outer boundary of heating field 10. Through an at least partial embedding of its turns in the insulating material of inner shell 5, heating resistor 8 can be immovably fixed with respect thereto. In ground plan, instead of being circular, the radiant heater body can also have a non-circular shape and can be round, rectangular or square and the heating resistor then appropriately follows this outer contour in its spiral shape.

Figure 3:
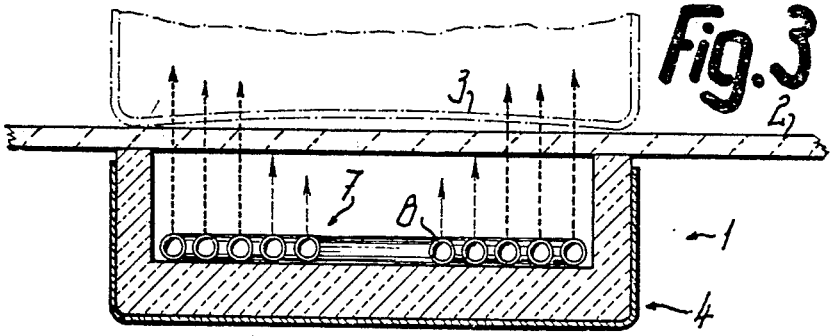
FIG. 3 is a diagrammatic representation of the distribution of the radiant power density in the initial cooking phase.
Figure 4:
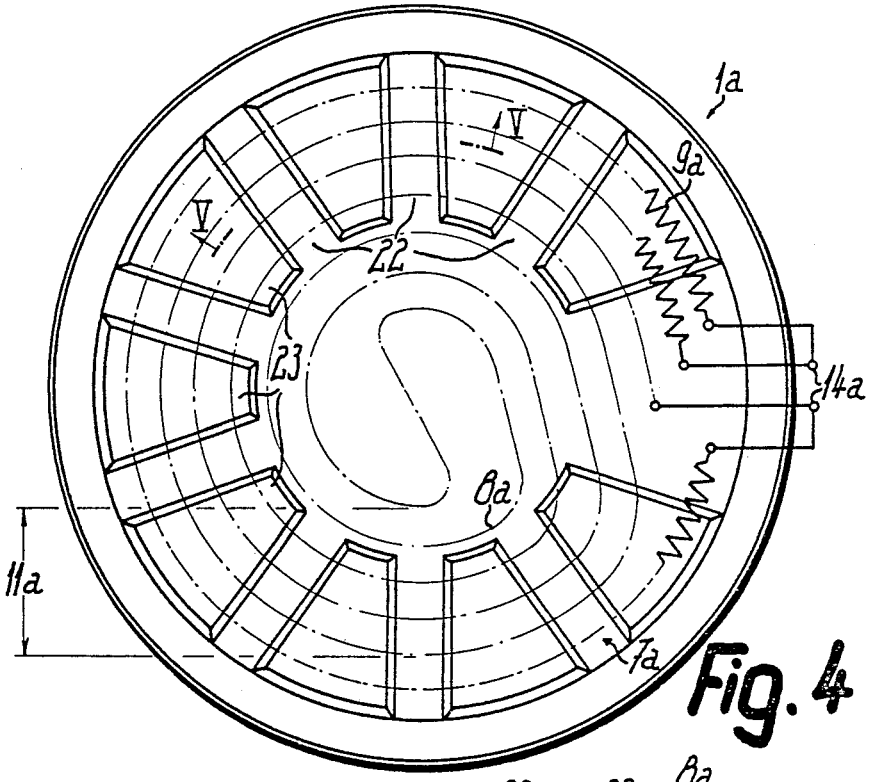
FIG. 4 is another embodiment of a radiant heater body in a representation corresponding to FIG. 2.
Figure 5:
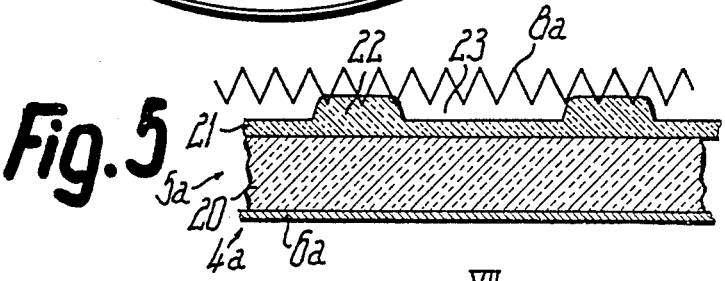
FIG. 5 is a section along line V—V in FIG. 4 in a developed representation.
Figure 6:
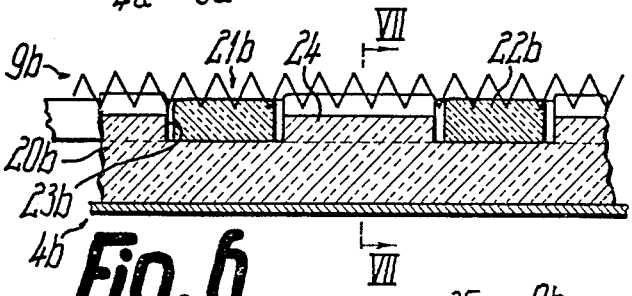
FIG. 6 is another embodiment in a representation corresponding to FIG. 5.
Figure 7:
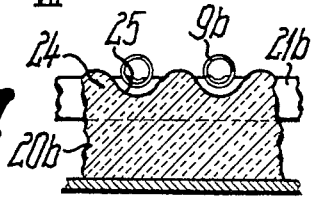
FIG. 7 is a section along line VII—VII in FIG. 6.

In FIGS. 4 to 7 corresponding parts are given the same reference numerals as in FIGS. 1 to 3, but are followed by the letter a in FIGS. 4 and 5 and by the letter b in FIGS. 6 and 7.

The radiant heater body 1*a* according to FIGS. 4 and 5 is provided as the initial cooking marginal heating system 9*a* with an outermost heating resistor located in a single-strand loop or in bifilar form and made from particularly thin, highly stressable resistance wire, i.e. a resistance wire, which is thinner and more highly loadable or loaded than that of the heating resistor associated with the partial power system 11*a*. Thus, the radiant heater of the radiant heater body 1*a* is constructed in the form of two circles, but the two heating circuits or circles are so connected in parallel or series that they are always simultaneously switched on and off.

As can be gathered from FIG. 5 inner shell 5*a* comprises two superimposed support bodies 20, 21 made from different insulating materials and thicknesses, the lower, plate-like, poured support body 20 comprising a pulverulent, compressed material, which is relatively compression-elastic, has a greater thickness than the moulded body 21 resting whole-surface manner thereon and which in particular has a thermal insulation value much higher than that of support body 21. The e.g. disk-shaped support body 21 is a relatively dimensionally stable shaped article made from molded mineral fibers, on which the heating resistors are held by zonal embedding. On the top surface of said support body 21, there are webs projecting upwards roughly by its remaining thickness, which are roughly radial to the central axis of the radiant heater body 1*a* and constructed in one piece with the remaining support body 21. The webs located only in the radially outer region of the heating field are in each case formed between depressions 23 extending from the periphery of the heating field only over part of the turns of the heating resistors. The turns located radially within the depressions 23, i.e. in the central region are consequently in direct contact with inner shell 5*a*. In the vicinity of webs 22 which, apart from the initial cooking marginal heating system 9*a*, also cover three further turns of heating resistor 8*a*, said turns are exclusively held on webs 22 by embedding, whereas according to FIG. 5 in the vicinity of the depressions they are suspended freely over the same, i.e. span or bridge in contact-free manner or only weakly engage with respect to inner shell 5*a*. The distance between the longitudinal portions of the heating resistors bridging the depressions parallel to the bottom surfaces thereof and said bottom surfaces can be smaller than the external diameter of said heating resistors and in particular roughly half as large, whilst the heating resistors are embedded in webs 22 by approximately half the external diameter thereof. The distance between adjacent webs can be approximately double the width thereof.

As shown by FIGS. 6 and 7, in place of depressions 23, the upper support body 21*b* can also have breaks or openings 23*b* extending through the thickness of support body 21*b* and which are at least partly filled in plug-in member-like manner by the projections 24 of the lower support body 20*b*. In the represented embodiment projections 24 extend slightly above the top surfaces of webs 22*b*, but in the vicinity of each of the longitudinal portions of the particular heating resistor traversing the same are provided with channel-like reception grooves 25, whose bottom surfaces can be located slightly deeper than the top surface of webs 21*b*. The depth of the reception grooves 25, with respect to which the associated longitudinal portions of the heating resistors can be provided in contact-free or in loosely engaging non-embedded manner, is appropriately sufficiently large to ensure that the adjacent reception grooves 25 of separating webs of support body 21*b* only extend roughly to the center of the external diameter of said longitudinal portions. As a result of the described construction the heat dissipation of said longitudinal portions of the radiant heater body located between webs 21*b* into inner shell 5*b* is particularly small, so that after said longitudinal portions have been switched on from the cold state, they very rapidly visibly glow. Due to the fact that the support body 20*b* is thickened over and beyond the underside of support body 21*b* by projections 24 in at least certain grid-like distributed zones, an excellent additional thermal insulation is obtained. However, it could also be planar.

In the case of the construction according to FIG. 1, regulating device 13 can be constructed in much the same way as that of DE OS No. 32 47 028 or that of EP-A-No. 01 14 307, to which reference should be made for further details. The initial cooking marginal heating system is located in the same space surrounded by support 4 and hotplate 2 as the remaining radiant heater 7 and is not separated in circular manner therefrom by an intermediate web of the support.

In the case of the invention, there is a higher specific power in the outer region and in certain circumstances this can be so high that it could not be expected of the heating resistor and/or glass ceramic hotplate in permanent operation. As a result of its mainly only temporary action and the higher power reduction in said area, particularly during the initial cooking phase, no harmful effects result therefrom. A higher specific power could be generally provided in the outer region. It mainly has its effect during the initial cooking time, in that the outer heating conductor glows more rapidly , so that the desired optical effects are obtained and there is an earlier heat transfer to the cooking utensil. During the final cooking phase, this power distribution with preference for the marginal region which is maintained without switching over has hardly any effect and certainly no negative effect, because the overall power is reduced e.g. by the timed switching on and off thereof. It has been found that a higher specific loading of the marginal region and in particular the outer heating conductor turn plays no significant part with respect to the life thereof, because even in the case of a certain overloading it does not burn through.

I claim:

1. A radiant heater unit (1) for heating in the vicinity of at least one cooking point of a heater plate (2), in an initial high power pre-heating phase and a subsequent reduced power cooking phase, said radiant heater comprising:

a support means (4);

an electric radiant heating means (7) supported by said support means (4), said radiant heating means (7) having at least one radiant heating resistor (8) and providing first and second regions adding up to a total power unit of the electric radiant heating means (7), said first and second regions being associated with first and second partial power units (9, 11) of said total power unit and providing associated radiant power densities;

said radiant heating means (7) extending from an annular periphery of a heating field (10) over a median zone into a central zone of the heating field (10), said periphery provided by said first region determining an associated firm magnitude of the heating field, said first region forming a marginal heating means (9) for the heating field (10) and said second region being located within said marginal heating means (9), thereby forming an inner region;

control means being provided for operating said electric radiant heating means (7) form said pre-heating phase to said reduced cooking phase, wherein said control means (13) are constructed for operating said marginal heating means (9) over at least a part of the pre-heating phase with a first radiant power density raised in comparison with said second region of the radiant heating means (7) and for operating said marginal heating means (9) in the reduced cooking phase with a second radiant power density, said second radiant power density being above zero but reduced with respect to said first radiant power density.

2. A radiant heater unit according to claim 1, wherein said control means are provided for automatically operating said marginal heating means (9) with said first radiant power density substantially over the entire initial cooking phase.

3. A radiant heater according to claim 1, wherein said control means are provided for ending the pre-heating phase by operating one of said partial power units (11) of the radiant heating means (7).

4. A radiant heater unit according to claim 1, wherein said control means comprises a temperature switch with a high switching temperature difference providing a broad switching hysteresis.

5. A radiant heater according to claim 1, wherein said control means comprises a temperature responsive means having a relatively low thermal coupling to the radiant heating means (7).

6. A radiant heater unit according to claim 1, wherein said control means for operating said pre-heating phase are formed by a circuit providing a short circuit for the inner region of the radiant heating means (7).

7. A radiant heater according to claim 1, wherein said inner region and the marginal heating means (9) are formed by a single radiant heating resistor (8).

8. A radiant heater according to claim 1, wherein the inner region of the radiant heating means (7) is formed by a radiant heating resistor having a high positive temperature coefficient (PTC).

9. A radiant heater according to claim 1, wherein the marginal heating means (9*a*) operated in the pre-heating cooking phase is formed by a separate heating circuit extending over approximately 360° in plan view.

10. A radiant heater unit according to claim 9, wherein said separate heating circuit is provided as a single strand.

11. A radiant heater according to claim 10, wherein the marginal heating means (9*a*) has a smaller specific surface contact with the support means (4*a*) than the inner region.

12. A radiant heater unit according to claim 9, wherein said separate heating circuit is provided as a bifilar strand.

13. A radiant heater unit according to claim 1, wherein at least the marginal heating means (9*a*) is connected to the support means (4*a*) by way of a lower thermal conduction coupling than the inner region of the radiant heating means (7*a*).

14. A radiant heating unit according to claim 1, wherein at least said heating resistor of the marginal heating means (9*a*) has longitudinal portions, the longitudinal portions of the heating resistor of the marginal heating means (9*a*) being arranged in substantially suspended, contact-free manner with respect to the support means (4*a*).

15. A radiant heater according to claim 1, wherein the support means (4*a*) provides a thick-walled inner shell (5*a*) made from insulating material and receiving the radial heating means (7*a*) and further provides a thin-walled outer shell (6*a*) forming a reinforcement.

16. A radiant heater unit according to claim 15, wherein a lower support body (20) is made from substantially pulverulent insulating material.

17. A radiant heater unit according to claim 1, wherein an upper support body (21*b*) is made from fibrous insulating material.

18. A radiant heater unit according to claim 1, wherein a temperature regulating device is provided for regulating the pre-heating phase, said regulating device (13) having a temperature sensor (17).

19. A radiant heater unit according to claim 18, wherein said temperature sensor (17) is constructed as an expansion rod sensor.

20. A radiant heating unit according to claim 18, wherein said temperature sensor (17) is thermally insulated by means of an insulating layer with respect to said radiant heating means (7).

21. A radiant heater according to claim 18, wherein said temperature sensors (17) is embedded in an inner shell (5) of the support means (4).

22. A radiant heater unit according to claim 1, wherein said heater plate (2) is a glass ceramic plate.

23. A radiant heater unit according to claim 1, wherein said inner region and the marginal heating means (9) are formed by a single electric heating circuit.

24. A radiant heater unit according to claim 1, wherein said control means comprise a resistor having a high positive temperature coefficient (PTC).

25. A radiant heater unit (1) for heating in the vicinity of at least one cooking point of a heater plate (2), said radiant heater comprising:

a support means (4);

an electric radiant heating member (7) supported by said support means (4) being formed from at least one radiant heating resistor (8) and providing regions adding up to a total power unit of the electric radiant heating member (7);

said radiant heating member (7) extending from an annular periphery of a heating field (10) over a central zone into a inner zone of the heating field, said periphery determining an associated firm magnitude of the heating field, wherein a first one of said regions of the radiant heating member is associated with a first partial power unit of said total power unit and forms the periphery of the heating field (10), said first region forming a marginal heating means (9) for the heating field (10), control means being provided for operating said electric radiant heating member over at least a part of an initial cooking phase with a radiant power density raised in comparison with a second one of said regions of the radiant heating member (7), said second region being associated with at least one second partial power unit (11) and being located within said marginal heating means (9), thereby forming an inner region, the control means for operating the pre-heating phase being at least partly formed by thermal conduction connections provided between the radiant heating means (7*a*) and the support means (4*a*), the thermal conduction connections of different regions of the radiant heating means (7*a*) having different thermal characteristics.

26. A radiant heater unit according to claim 25, wherein the control means for operating the pre-heating phase is exclusively formed by the thermal conduction connections provided between the radiant heating means (7*a*) and the support means (4*a*).

27. A radiant heater unit (1) for heating in the vicinity of at least one cooking point of a heater plate (2), said radiant heater unit comprising:

a support means (4);

an electric radiant heating member (7) supported by said support means (4) being formed from at least one radiant heating resistor (8) and providing regions adding up to a total power unit of the electric radiant heating member (7);

said radiant heating member (7) extending from an annular periphery of a heating field (10) over a central zone into an inner zone of the heating field, said periphery determining an associated firm magnitude of the heating field, wherein a first one of said first regions of the radiant heating member is associated with a first partial power unit of said total power unit and forms the periphery of the heating field (10), said first region forming a marginal heating means (9) for the heating field (10), control means being provided for operating said electric radiant heating member over at least a part of an initial cooking phase with a radiant power density raised in comparison with a second one of said regions of the radiant heating members (7), said second region being associated with at least one second partial power unit (11) and being located within said marginal heating means (9), thereby forming an inner region, longitudinal portions of at least the heating resistor of the marginal heating means (9*b*) being arranged in alternating manner in different zones of the support means (4*b*) said zones having different thermal conductivity characteristics.

28. A radiant heater unit according to claim 27, wherein a side of the support means (4*b*) receiving the radiant heating means is formed by a two upper and lower superimposed support bodies (20*b*, 21*b*), whereof the lower support body has a lower specific thermal conductivity and penetrates openings (23*b*) in the upper support body (21*b*) at least in the vicinity of the marginal heating means (9*b*).

* * * * *

UNITED STATES PATENT AND TRADEMARK OFFICE

CERTIFICATE OF CORRECTION

PATENT NO. : 4,810,857

DATED : March 7, 1989

INVENTOR(S) : Gerhard Goessler

It is certified that error appears in the above-identified patent and that said Letters Patent is hereby corrected as shown below:

Column 9, line 27 delete "form" and insert --from--.

Column 10, line 28 delete "radial" and insert --radiant--.

Signed and Sealed this

Second Day of July, 1991

*Attest:*

*Attesting Officer*

HARRY F. MANBECK, JR.

*Commissioner of Patents and Trademarks*